US008989631B2

(12) United States Patent
Yamashita et al.

(10) Patent No.: US 8,989,631 B2
(45) Date of Patent: Mar. 24, 2015

(54) IMAGE-FORMING APPARATUS AND METHOD

(71) Applicant: Fuji Xerox Co., Ltd., Minato-ku, Tokyo (JP)

(72) Inventors: Takayuki Yamashita, Ebina (JP); Sakon Takahashi, Ebina (JP); Yutaka Kiuchi, Ebina (JP); Masayo Higashimura, Ebina (JP); Kunihiko Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/151,450

(22) Filed: Jan. 9, 2014

(65) Prior Publication Data

US 2014/0341615 A1 Nov. 20, 2014

(30) Foreign Application Priority Data

May 17, 2013 (JP) ..... 2013-105295

(51) Int. Cl.

*G03G 15/01* (2006.01)
*G03G 9/08* (2006.01)
*G03G 15/20* (2006.01)

(52) U.S. Cl.

CPC ..... *G03G 9/0819* (2013.01); *G03G 15/20* (2013.01)
USPC ..... 399/231; 399/40; 399/45

(58) Field of Classification Search

USPC ..... 399/223, 231
See application file for complete search history.

(56) References Cited

U.S. PATENT DOCUMENTS

| | | | | |
|---|---|---|---|---|
| 7,783,242 | B2 * | 8/2010 | Chigono et al. | 399/341 |
| 7,805,101 | B2 * | 9/2010 | DiRubio et al. | 399/308 |
| 2004/0057748 | A1 * | 3/2004 | Egusa et al. | 399/107 |

FOREIGN PATENT DOCUMENTS

| | | | |
|---|---|---|---|
| JP | 2-001351 | A | 1/1990 |
| JP | 6-186787 | A | 7/1994 |

* cited by examiner

*Primary Examiner* — Clayton E Laballe
*Assistant Examiner* — Leon W Rhodes, Jr.
(74) *Attorney, Agent, or Firm* — Sughrue Mion, PLLC

(57) ABSTRACT

An image-forming apparatus includes an image unit that forms an image using a white toner and a color toner and a fixing unit that fixes the image to a medium with heat. The toner mass per unit area of the white toner θ (g/m$^2$) in an image of the color toner superimposed on the white toner formed on paper used as the medium satisfies:

$$0.03+1.31\times Rw-0.47\times Rc+0.02\times Gw-0.07\times Gc\leq\theta\leq 0.05+1.06\times Rw+0.42\times Rc-0.02\times Gw+0.05\times Gc$$

where Rw is the average particle diameter (μm) of the white toner, Rc is the average particle diameter (μm) of the color toner, Gw is the storage modulus (kPa) of the white toner at 120° C., and Gc is the storage modulus (kPa) of the color toner at 120° C.

4 Claims, 13 Drawing Sheets

FIG. 3

| EXPERIMENT NO. | FIGURE NO. | STORAGE MODULUS OF WHITE TONER (Pa) | STORAGE MODULUS OF COLOR TONER (Pa) | MEDIUM P | REMARKS |
|---|---|---|---|---|---|
| EXPERIMENT 1 | FIG. 4 | $1.5\times10^3$ | $1.5\times10^3$ | COLOR PAPER | EXPERIMENT FOR DETERMINING LOWER LIMIT OF TMA |
| EXPERIMENT 2 | FIG. 5 | $6\times10^3$ | $1.5\times10^3$ | COLOR PAPER | EXPERIMENT FOR DETERMINING LOWER LIMIT OF TMA |
| EXPERIMENT 3 | FIG. 6 | $45\times10^3$ | $1.5\times10^3$ | COLOR PAPER | EXPERIMENT FOR DETERMINING LOWER LIMIT OF TMA |
| EXPERIMENT 4 | FIG. 7 | $6\times10^3$ | $6\times10^3$ | COLOR PAPER | EXPERIMENT FOR DETERMINING LOWER LIMIT OF TMA |
| EXPERIMENT 5 | FIG. 8 | $1.5\times10^3$ | $1.5\times10^3$ | COLOR PAPER | EXPERIMENT FOR DETERMINING UPPER LIMIT OF TMA |
| EXPERIMENT 6 | FIG. 9 | $6\times10^3$ | $1.5\times10^3$ | COLOR PAPER | EXPERIMENT FOR DETERMINING UPPER LIMIT OF TMA |
| EXPERIMENT 7 | FIG. 10 | $45\times10^3$ | $1.5\times10^3$ | COLOR PAPER | EXPERIMENT FOR DETERMINING UPPER LIMIT OF TMA |
| EXPERIMENT 8 | FIG. 11 | $6\times10^3$ | $6\times10^3$ | COLOR PAPER | EXPERIMENT FOR DETERMINING UPPER LIMIT OF TMA |
| EXPERIMENT 9 | FIG. 12 | $1.5\times10^3$ | $1.5\times10^3$ | FILM | EXPERIMENT FOR DETERMINING LOWER LIMIT OF TMA |
| EXPERIMENT 10 | FIG. 13 | $6\times10^3$ | $1.5\times10^3$ | FILM | EXPERIMENT FOR DETERMINING LOWER LIMIT OF TMA |
| EXPERIMENT 11 | FIG. 14 | $45\times10^3$ | $1.5\times10^3$ | FILM | EXPERIMENT FOR DETERMINING LOWER LIMIT OF TMA |
| EXPERIMENT 12 | FIG. 15 | $6\times10^3$ | $6\times10^3$ | FILM | EXPERIMENT FOR DETERMINING LOWER LIMIT OF TMA |
| EXPERIMENT 13 | FIG. 16 | $1.5\times10^3$ | $1.5\times10^3$ | FILM | EXPERIMENT FOR DETERMINING UPPER LIMIT OF TMA |
| EXPERIMENT 14 | FIG. 17 | $6\times10^3$ | $1.5\times10^3$ | FILM | EXPERIMENT FOR DETERMINING UPPER LIMIT OF TMA |
| EXPERIMENT 15 | FIG. 18 | $45\times10^3$ | $1.5\times10^3$ | FILM | EXPERIMENT FOR DETERMINING UPPER LIMIT OF TMA |
| EXPERIMENT 16 | FIG. 19 | $6\times10^3$ | $6\times10^3$ | FILM | EXPERIMENT FOR DETERMINING UPPER LIMIT OF TMA |

IMAGE-FORMING APPARATUS AND METHOD

CROSS-REFERENCE TO RELATED APPLICATIONS

This application is based on and claims priority under 35 USC 119 from Japanese Patent Application No. 2013-105295 filed May 17, 2013.

BACKGROUND

Technical Field

The present invention relates to image-forming apparatuses and methods.

SUMMARY

According to an aspect of the invention, there is provided an image-forming apparatus including an image unit that forms an image using a white toner and a color toner and a fixing unit that fixes the image to a medium with heat. The toner mass per unit area of the white toner θ (g/m$^2$) in an image of the color toner superimposed on the white toner formed on paper used as the medium satisfies:

$$0.03+1.31\times Rw-0.47\times Rc+0.02\times Gw-0.07\times Gc\leq\theta\leq 0.05+1.06\times Rw+0.42\times Rc-0.02\times Gw+0.05\times Gc$$

(where Rw is the average particle diameter (μm) of the white toner, Rc is the average particle diameter (μm) of the color toner, Gw is the storage modulus (kPa) of the white toner at 120° C., and Gc is the storage modulus (kPa) of the color toner at 120° C.).

BRIEF DESCRIPTION OF THE DRAWINGS

Exemplary embodiments of the present invention will be described in detail based on the following figures, wherein:

FIG. 3 is a table listing the storage moduli of white toners and color toners used in Experiments 1 to 16;

DETAILED DESCRIPTION

Figure 1:
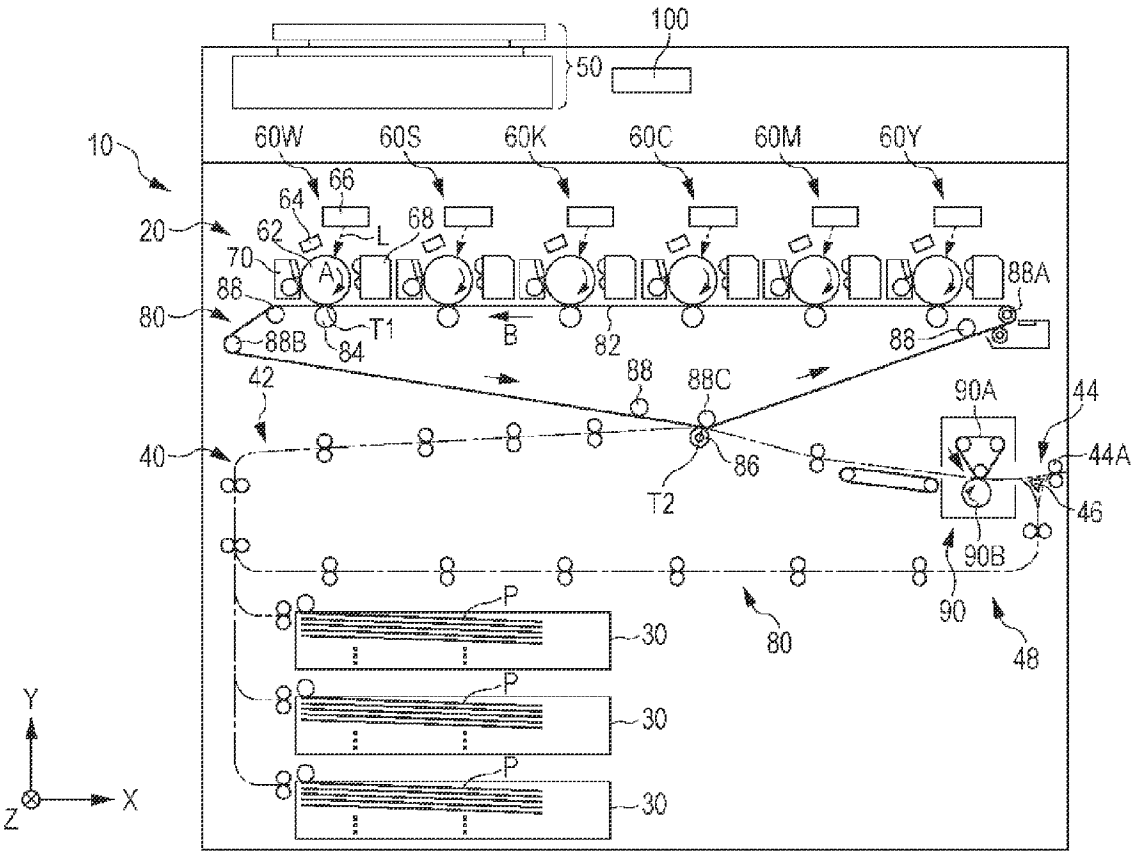
FIG. 1 is a schematic view illustrating the overall structure of an image-forming apparatus according to a first exemplary embodiment.

Exemplary embodiments of the present invention will now be described with reference to the drawings. The structure of an image-forming apparatus will be described first, and then the normal and special operations of the image-forming apparatus will be described. In the following description, the direction indicated by arrow Y in FIG. 1 is referred to as "apparatus height direction", and the direction indicated by arrow X in FIG. 1 is referred to as "apparatus width direction". The direction perpendicular to the apparatus height direction and the apparatus width direction is referred to as "apparatus depth direction" (indicated by arrow Z).

First Exemplary Embodiment

Structure of Image-Forming Apparatus

FIG. 1 is a schematic front view illustrating the overall structure of an image-forming apparatus 10 according to a first exemplary embodiment. As shown in FIG. 1, the image-forming apparatus 10 includes an electrophotographic image-forming section 20 that forms an image on a medium P, a medium transport section 40 that transports the medium P, and a document reader 50 that reads a document to be read (not shown). The image-forming apparatus 10 also includes medium containers 30 each containing a stack of media P and a controller 100 that controls the various sections.

Image-Forming Section

As shown in FIG. 1, the image-forming section 20 includes toner-image forming units 60Y, 60M, 60C, 60K, 60S, and 60W provided for yellow (Y), magenta (M), cyan (C), black (K), special color (S), and white (W) toners, respectively, an intermediate transfer device 80, and a fixing device 90.

The toner-image forming units 60Y, 60M, 60C, 60K, 60S, and 60W are examples of image units. The intermediate transfer device 80 is an example of a transfer unit. The fixing device 90 is an example of a fixing unit.

Yellow (Y), magenta (M), cyan (C), black (K), special color (S), and white (W) are examples of toner colors. The white (W) toner is an example of a white toner. The yellow (Y), magenta (M), cyan (C), and black (K) toners are examples of color toners.

The special color (S) is a color other than yellow (Y), magenta (M), cyan (C), black (K), and white (W). Examples of special colors (S) include gold (G), silver (S), transparent color (CL), and corporate colors (C/C). Corporate colors (C/C) are colors that are unique to individual users and are more frequently used than other colors.

Toner-Image Forming Unit

The toner-image forming units 60Y, 60M, 60C, 60K, 60S, and 60W have substantially the same structure except for the toner used. Therefore, in FIG. 1, reference numerals are provided for the components of the toner-image forming unit 60W and not for the components of the toner-image forming units 60Y, 60M, 60C, 60K, and 60S. The toner-image forming units 60Y, 60M, 60C, 60K, 60S, and 60W and the components thereof will now be described, where the suffixes Y, M, C, K, S, and W are omitted unless necessary.

Figure 2:
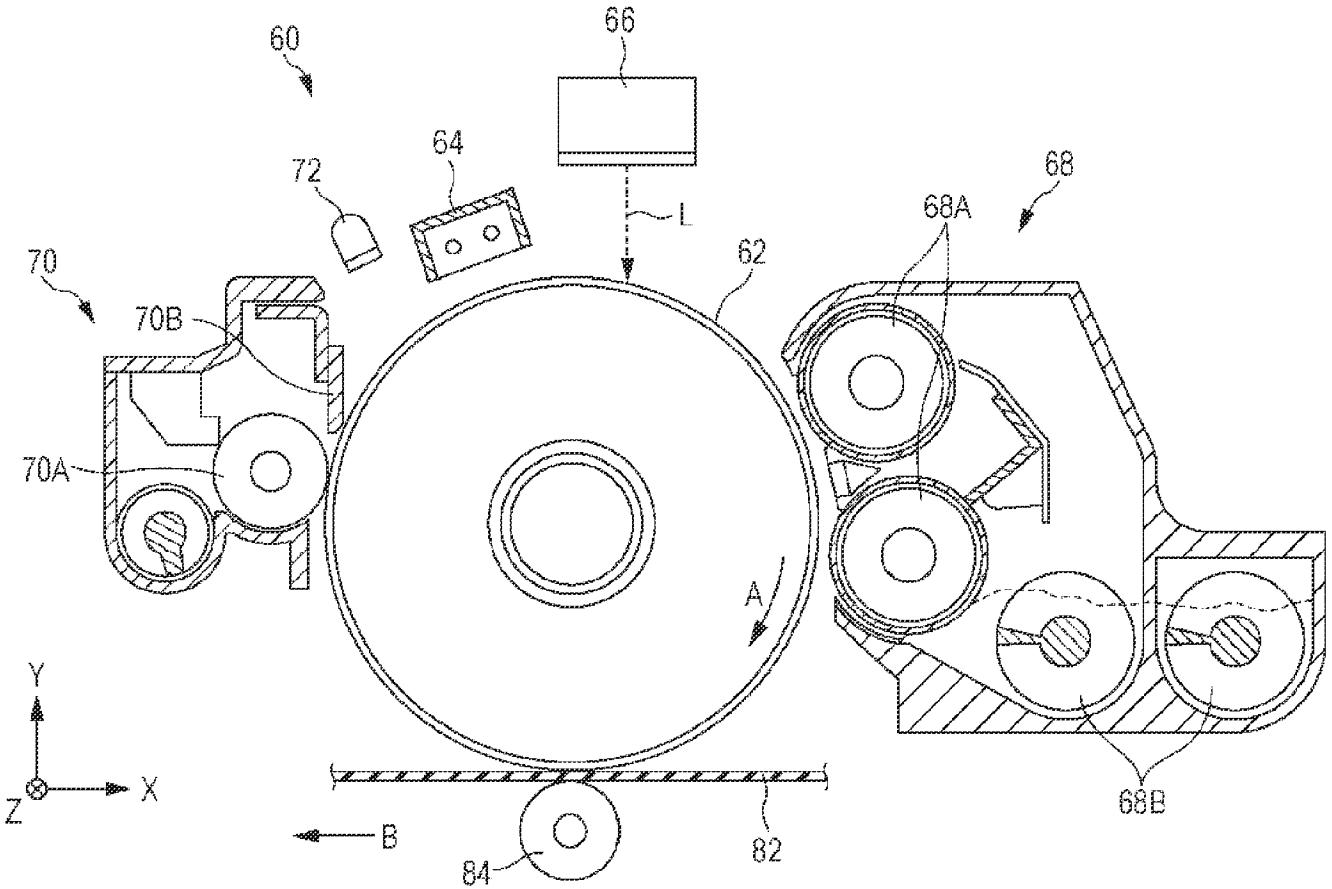
FIG. 2 is a schematic view illustrating the structure of each toner-image forming unit and the surrounding units according to the first exemplary embodiment.
Figure 4:
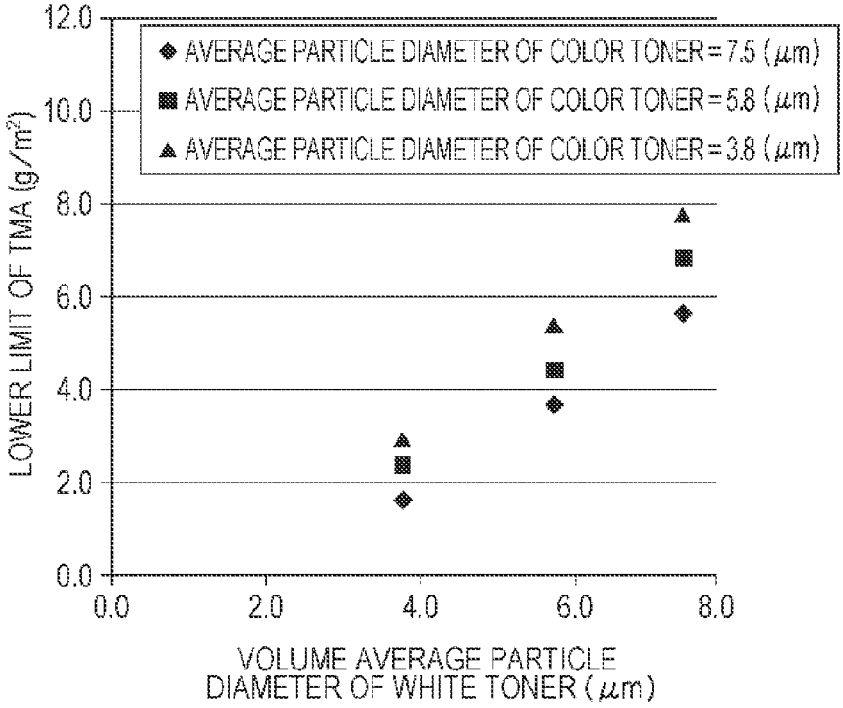
FIG. 4 is a graph showing the results (lower limit of TMA on color paper) of an experiment (Experiment 1) according to the first exemplary embodiment.
Figure 5:
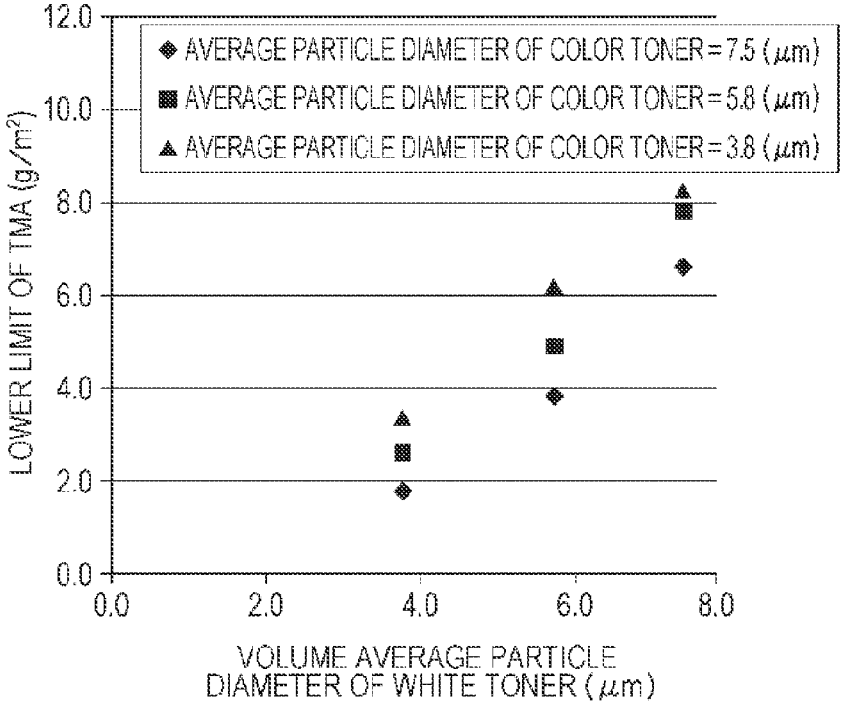
FIG. 5 is a graph showing the results (lower limit of TMA on color paper) of an experiment (Experiment 2) according to the first exemplary embodiment.
Figure 6:
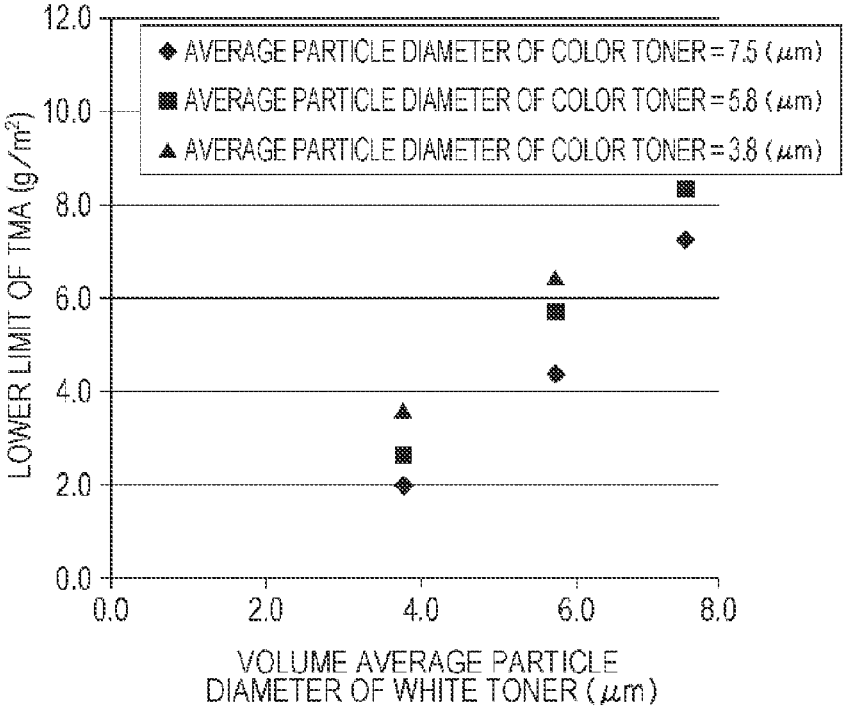
FIG. 6 is a graph showing the results (lower limit of TMA on color paper) of an experiment (Experiment 3) according to the first exemplary embodiment.
Figure 7:
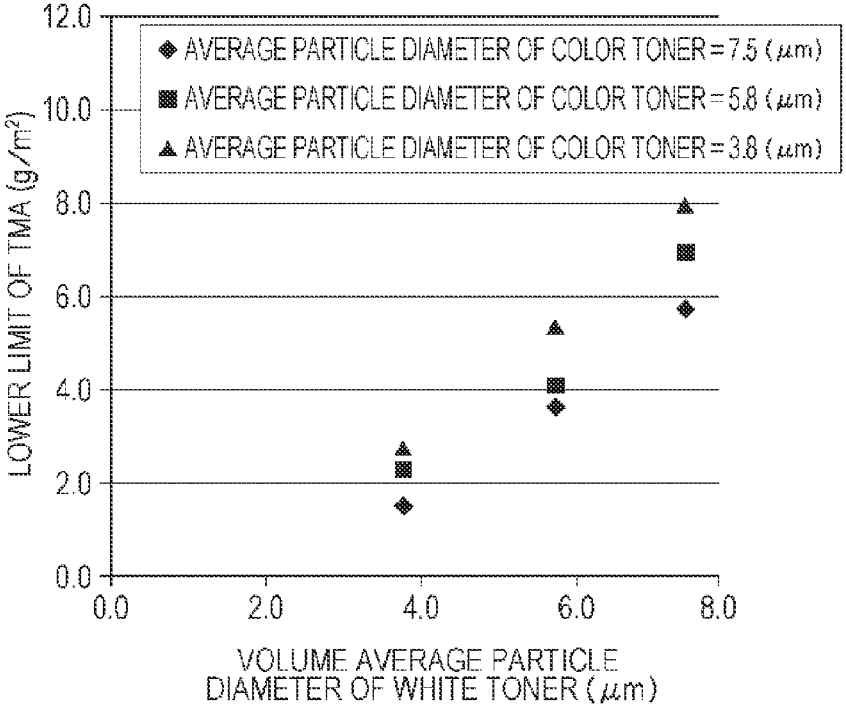
FIG. 7 is a graph showing the results (lower limit of TMA on color paper) of an experiment (Experiment 4) according to the first exemplary embodiment.
Figure 8:
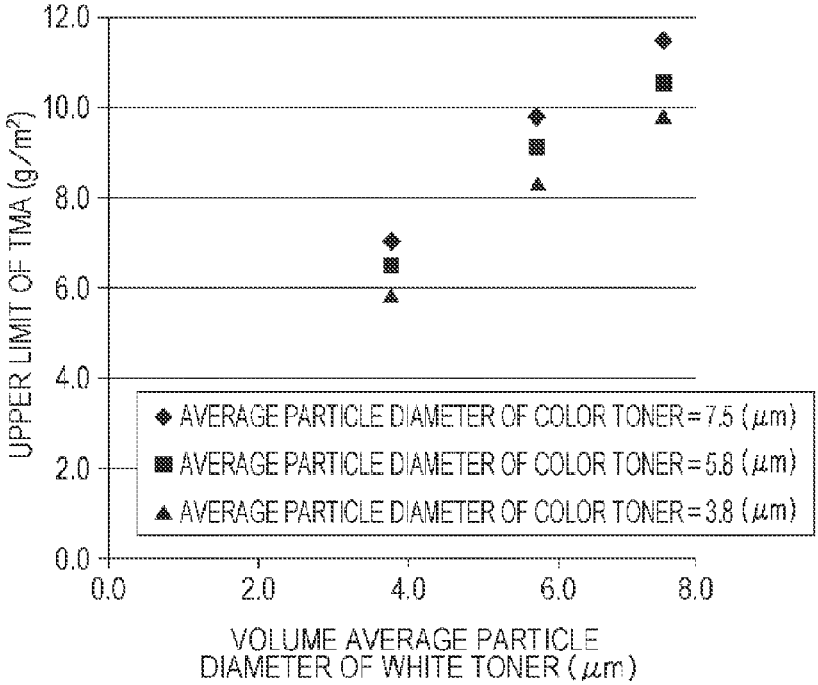
FIG. 8 is a graph showing the results (upper limit of TMA on color paper) of an experiment (Experiment 5) according to the first exemplary embodiment.
Figure 9:
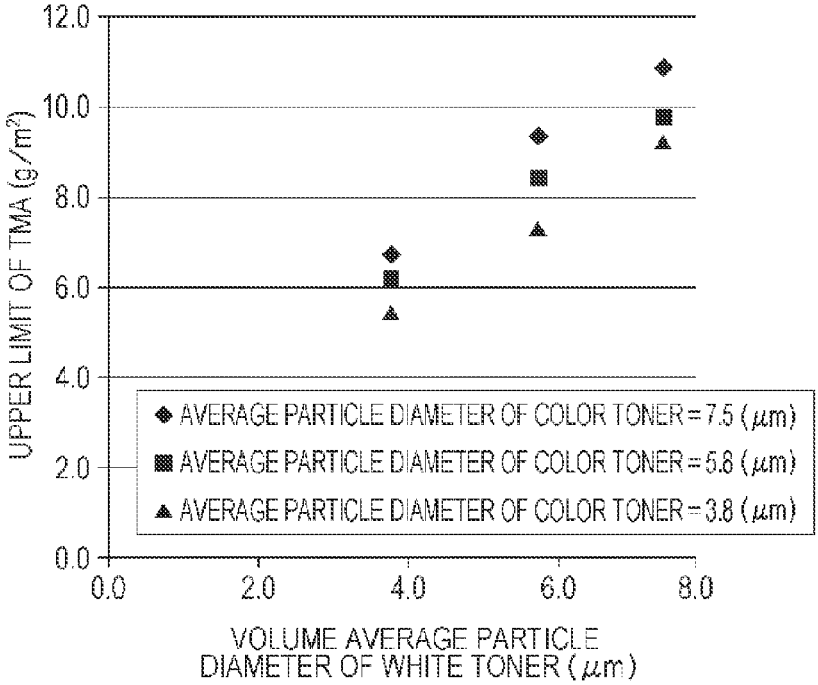
FIG. 9 is a graph showing the results (upper limit of TMA on color paper) of an experiment (Experiment 6) according to the first exemplary embodiment.
Figure 10:
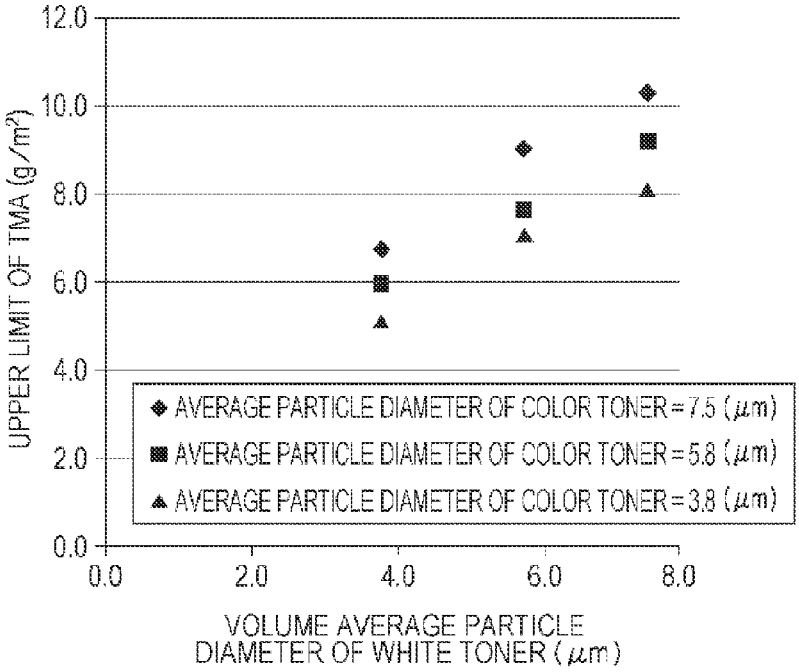
FIG. 10 is a graph showing the results (upper limit of TMA on color paper) of an experiment (Experiment 7) according to the first exemplary embodiment.
Figure 11:
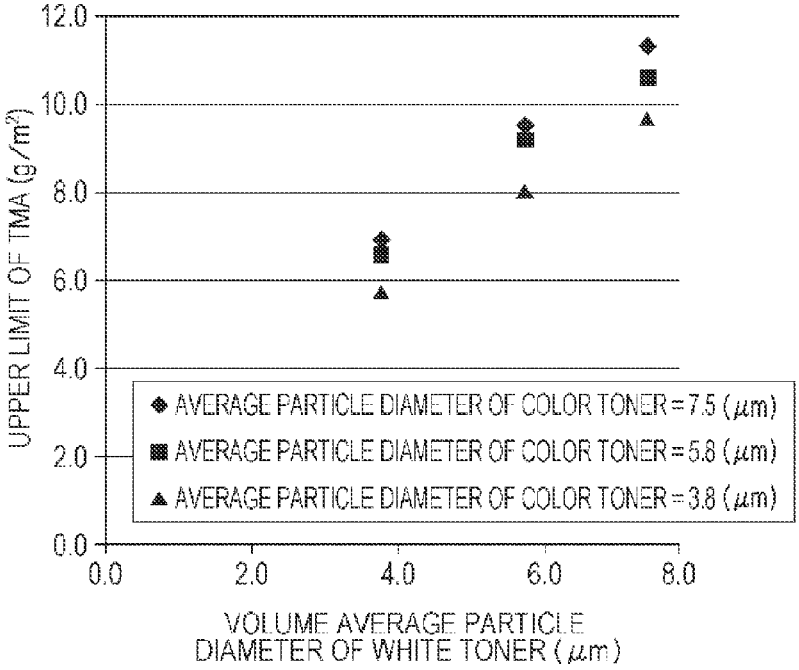
FIG. 11 is a graph showing the results (upper limit of TMA on color paper) of an experiment (Experiment 8) according to the first exemplary embodiment.
Figure 12:
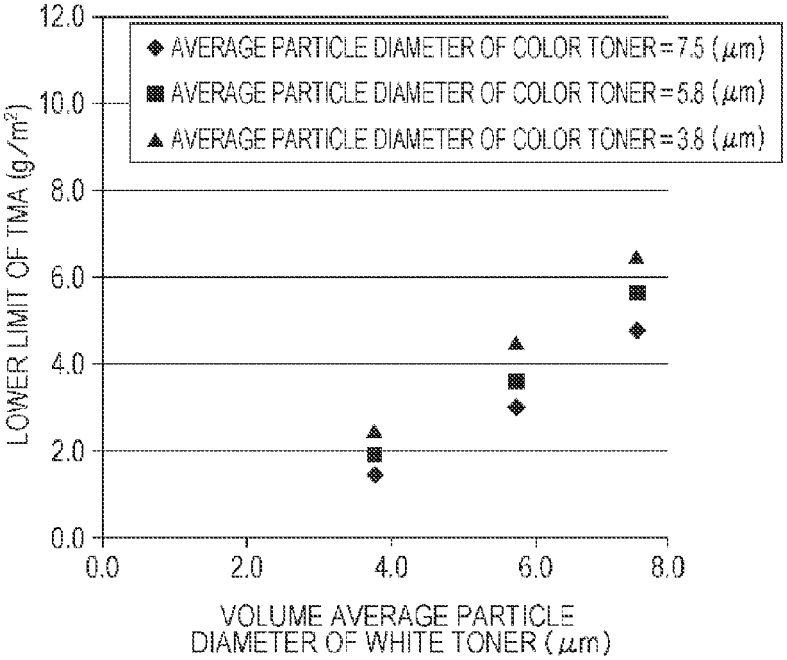
FIG. 12 is a graph showing the results (lower limit of TMA on a film) of an experiment (Experiment 9) according to a second exemplary embodiment.
Figure 13:
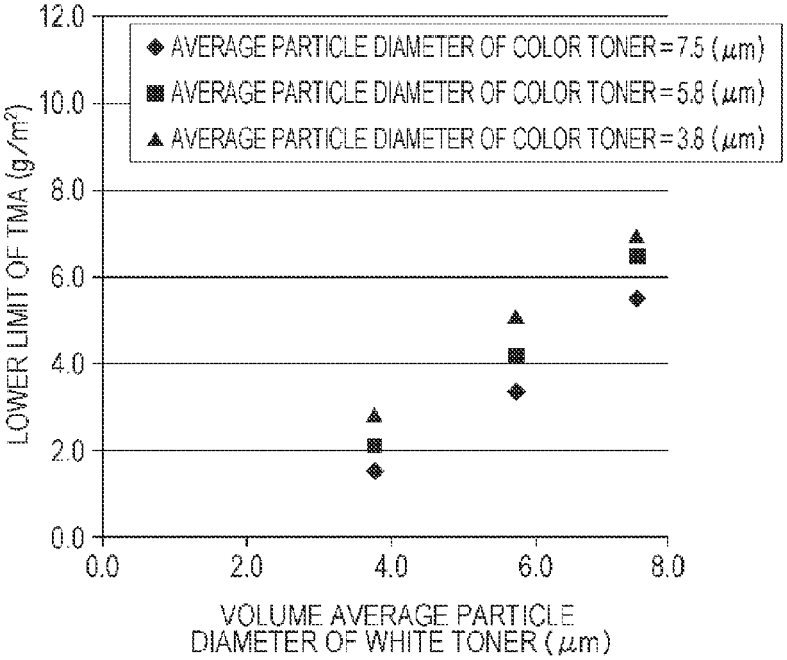
FIG. 13 is a graph showing the results (lower limit of TMA on a film) of an experiment (Experiment 10) according to the second exemplary embodiment.
Figure 14:
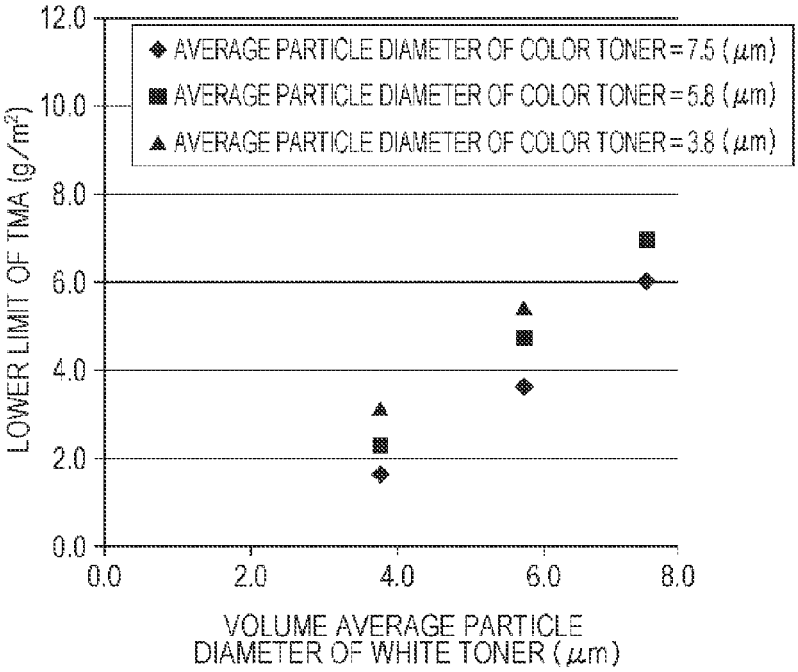
FIG. 14 is a graph showing the results (lower limit of TMA on a film) of an experiment (Experiment 11) according to the second exemplary embodiment.
Figure 15:
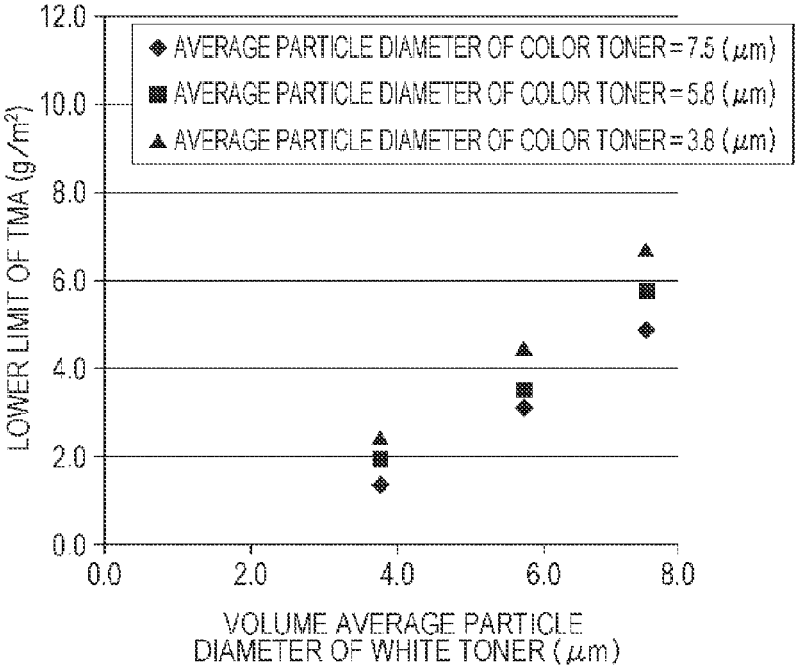
FIG. 15 is a graph showing the results (lower limit of TMA on a film) of an experiment (Experiment 12) according to the second exemplary embodiment.
Figure 16:
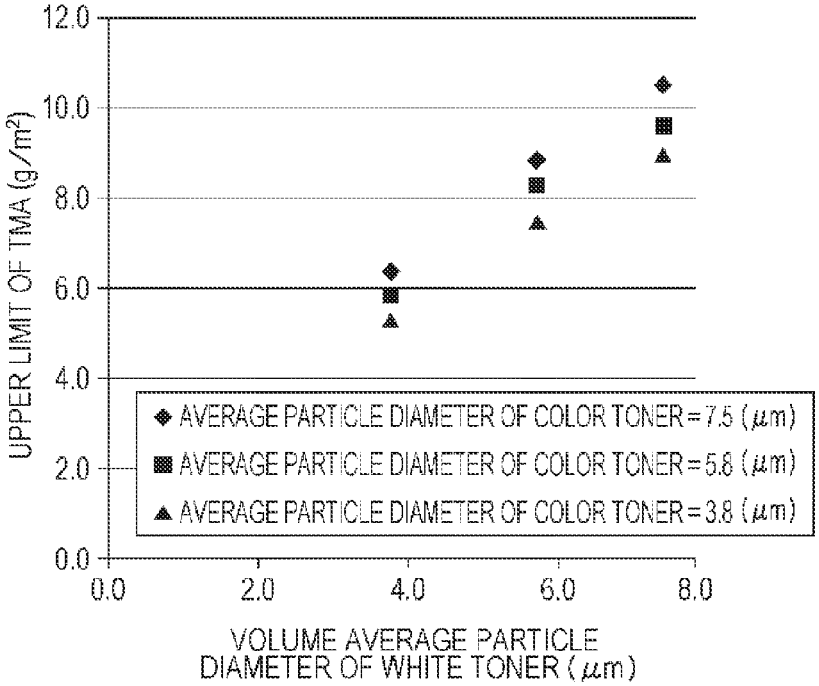
FIG. 16 is a graph showing the results (upper limit of TMA on a film) of an experiment (Experiment 13) according to the second exemplary embodiment.
Figure 17:
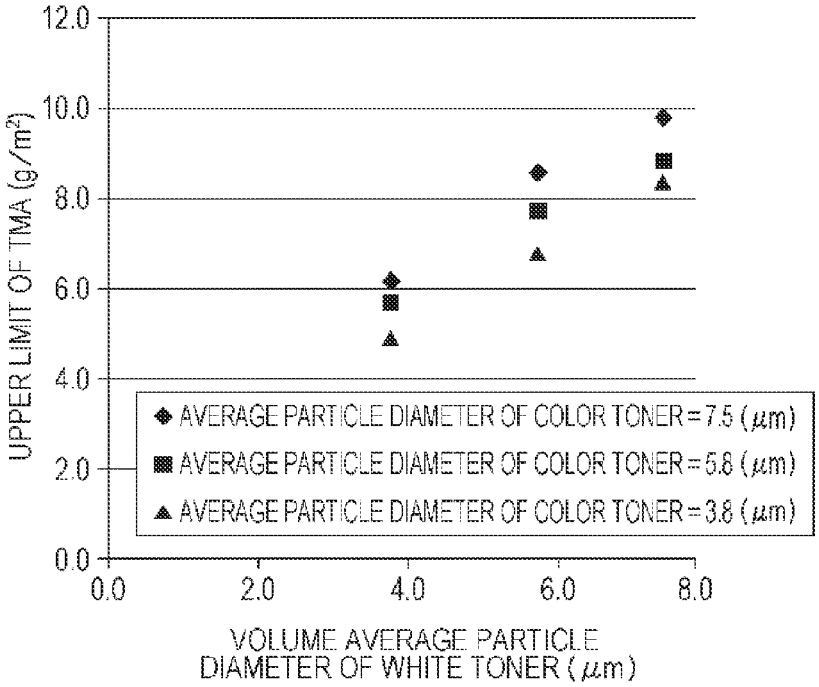
FIG. 17 is a graph showing the results (upper limit of TMA on a film) of an experiment (Experiment 14) according to the second exemplary embodiment.
Figure 18:
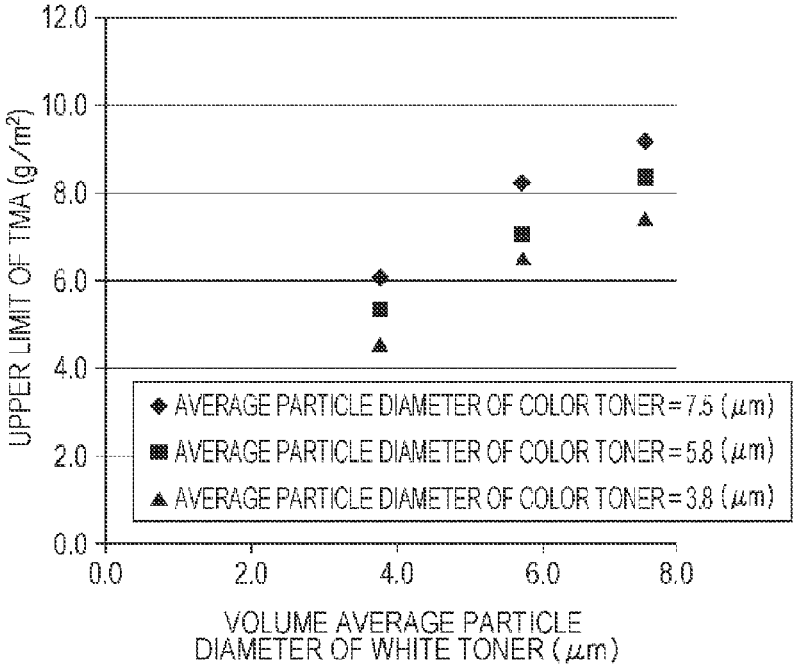
FIG. 18 is a graph showing the results (upper limit of TMA on a film) of an experiment (Experiment 15) according to the second exemplary embodiment.
Figure 19:
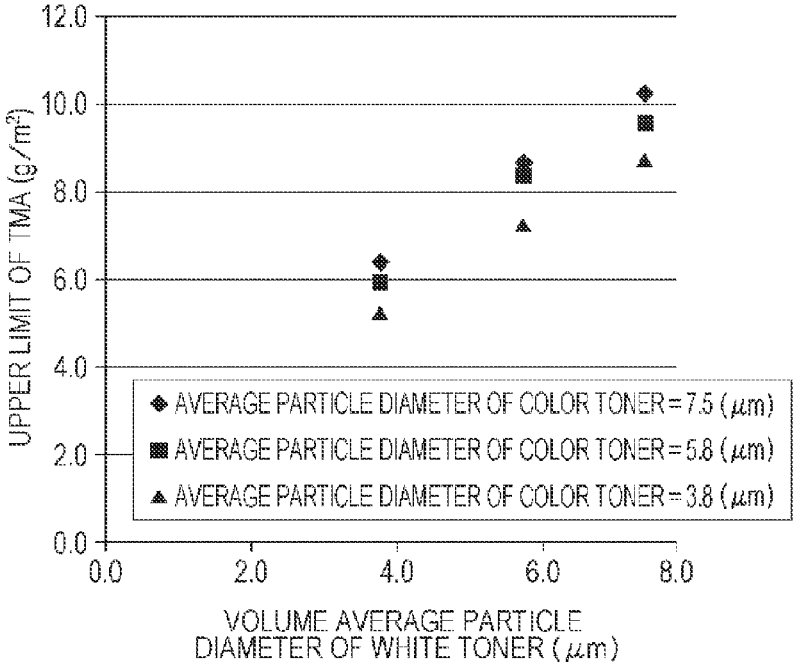
FIG. 19 is a graph showing the results (upper limit of TMA on a film) of an experiment (Experiment 16) according to the second exemplary embodiment.

FIG. 2 is a schematic front view illustrating the structure of each toner-image forming unit 60 and the surrounding units. As shown in FIG. 2, the toner-image forming unit 60 includes a photoreceptor drum 62, a charging device 64, an exposure device 66, a developing device 68, a removing device 70, and an erasing device 72.

The photoreceptor drum 62 is an example of an image carrier. The charging device 64 is an example of a charging unit. The exposure device 66 is an example of a latent-image forming unit. The developing device 68 is an example of a developing unit.

The toner-image forming units 60Y, 60M, 60C, 60K, 60S, and 60W form yellow (Y), magenta (M), cyan (C), black (K), special color (S), and white (W) toner images, respectively, on the outer surfaces of the photoreceptors drum 62Y, 62M, 62C, 62K, 62S, and 62W. As shown in FIG. 1, the toner-image forming units 60Y, 60M, 60C, 60K, 60S, and 60W as a whole are arranged side by side horizontally in the apparatus width direction.

Photoreceptor Drum

As shown in FIGS. 1 and 2, the photoreceptor drum 62 is cylindrical and is rotated about the axis thereof (in the direction indicated by arrow A (see FIGS. 1 and 2)) by a drive unit (not shown). The photoreceptor drum 62 includes an aluminum substrate and a photosensitive layer (not shown) including an undercoat layer, a charge generation layer, and a charge transport layer that are formed on the substrate in the above order. The photoreceptor drum 62 may further include an overcoat layer formed on the outer surface of the charge transport layer such that an electrostatic latent image is formed on the outer surface of the overcoat layer.

Charging Device

As shown in FIGS. 1 and 2, the charging device 64 is disposed along the axis of the photoreceptor drum 62 (in the apparatus depth direction). The charging device 64 negatively charges the outer surface of the photoreceptor drum 62. In this exemplary embodiment, the charging device 64 is a scorotron charging device, which is a type of corona charging device (non-contact charging device).

Exposure Device

As shown in FIGS. 1 and 2, the exposure device 66 forms an electrostatic latent image on the outer surface of the photoreceptor drum 62 charged by the charging device 64. The exposure device 66 outputs exposure light L emitted from a light-emitting diode (LED) array (not shown) based on image data received from an image signal processor (not shown) that forms part of the controller 100. The exposure light L is incident on the outer surface of the photoreceptor drum 62 charged by the charging device 64 to form an electrostatic latent image on the outer surface of the photoreceptor drum 62.

Developing Device

As shown in FIGS. 1 and 2, the developing device 68 is disposed along the axis of the photoreceptor drum 62. The developing device 68 includes toner supply members 68A that supply toner to the outer surface of the photoreceptor drum 62 and transport members 68B that transport toner to the toner supply members 68A (see FIG. 2). The developing device 68 develops the electrostatic latent image formed by the exposure device 66 on the outer surface of the photoreceptor drum 62 charged by the charging device 64 to form a toner image.

Removing Device

As shown in FIGS. 1 and 2, the removing device 70 is disposed along the axis of the photoreceptor drum 62. The removing device 70 includes a brush roller 70A and a blade 70B that are in contact with the outer surface of the photoreceptor drum 62. The brush roller 70A and the blade 70B remove toner (first transfer residual toner) remaining on the outer surface of the photoreceptor drum 62 without being transferred to an intermediate transfer belt 82, described later, as well as dust such as paper dust, from the outer surface of the photoreceptor drum 62.

Erasing Device

As shown in FIG. 2, the erasing device 72 is disposed along the axis of the photoreceptor drum 62. The erasing device 72 irradiates the outer surface of the photoreceptor drum 62 with light after the removing device 70 removes residual toner (first transfer residual toner) and dust such as paper dust. This irradiation allows the outer surface of the photoreceptor drum 62 to have a more uniform charge potential, thereby enabling the next image-forming operation.

Intermediate Transfer Device

As shown in FIG. 1, the intermediate transfer device 80 includes the intermediate transfer belt 82, six first transfer rollers 84, a second transfer roller 86, and rollers 88. The intermediate transfer device 80 transfers the toner images from the photoreceptor drums 62 provided for the individual toners to the intermediate transfer belt 82 such that they are superimposed on top of each other. The superimposed toner image is transferred to the medium P.

The intermediate transfer belt 82 is an endless belt entrained about the six first transfer rollers 84 and the rollers 88 and thereby set in a predetermined shape. In this exemplary embodiment, as shown in FIG. 1, the intermediate transfer belt 82 is set in the shape of an inverted obtuse triangle elongated in the apparatus width direction as viewed from the front of the image-forming apparatus 10.

Of the rollers 88 shown in FIG. 1, the roller 88A functions as a drive roller that is driven by a motor (not shown) to move the intermediate transfer belt 82 in the direction indicated by arrow B. Of the rollers 88 shown in FIG. 1, the roller 88B functions as a tension roller that tensions the intermediate transfer belt 82. Of the rollers 88 shown in FIG. 1, the roller 88C functions as a counter roller for the second transfer roller 86, described later.

As shown in FIG. 1, the intermediate transfer belt 82 is disposed in contact with the photoreceptor drums 62 from below in the apparatus height direction so as to form transfer nips T1 on the top side thereof, which extends in the apparatus width direction, in the shape described above. As the first transfer rollers 84 apply a first transfer bias voltage to the toner images formed on the photoreceptor drums 62, the toner images are transferred to the outer surface of the intermediate transfer belt 82 moving through the transfer nips T1.

As shown in FIG. 1, the intermediate transfer belt 82 is also disposed in contact with the second transfer roller 86 so as to form a transfer nip T2 at the bottom vertex thereof, which makes an obtuse angle. The toner image on the outer surface of the intermediate transfer belt 82 is supported and moved by the intermediate transfer belt 82. As the second transfer roller 86 applies a second transfer bias voltage to the toner image on the outer surface of the intermediate transfer belt 82, the toner image is transferred to the medium P passing through the transfer nip T2.

Fixing Device

The fixing device 90 includes a fixing belt 90A and a pressing roller 90B. As shown in FIG. 1, the fixing device 90 is disposed downstream of the transfer nip T2 in the transport direction of the medium P. The fixing device 90 fixes the toner image transferred to the medium P to the medium P. The fixing belt 90A is disposed opposite the side of the medium P to which the toner image is transferred. A heat source (not shown) that heats the fixing belt 90A is disposed inside the fixing belt 90A. The pressing roller 90B presses the medium P passing through the position opposite the fixing belt 90A (see FIG. 1) against the fixing belt 90A.

Medium Transport Section

The medium transport section 40 includes a medium feed unit 42 that feeds the media P to the image-forming section 20 and a medium output unit 44 that outputs a medium P on which an image is formed.

The medium feed unit 42 feeds the media P one by one to the transfer nip T2 in the image-forming section 20 in accordance with the timing of transfer. The medium output unit 44 outputs a medium P to which a toner image is fixed by the fixing device 90 outside the image-forming apparatus 10.

The medium transport section 40 also includes a retransport unit 48 that feeds a medium P to which a toner image is fixed on the front side thereof to the image-forming section 20 again. The medium transport section 40, including the retransport unit 48 as well as a transport roller 44A and a transport-direction switching unit 46, described later, allows a toner image to be formed on the front or back side of a medium P to which a toner image is fixed on the front side thereof.

To form images on both sides of the medium P, the medium transport section 40 outputs the leading portion of the medium P outside the image-forming apparatus 10. The medium transport section 40 then rotates the transport roller 44A in the reverse direction to draw the medium P back into the image-forming apparatus 10. At the same time, the medium transport section 40 switches the transport-direction switching unit 46, which is disposed between the fixing device 90 and the transport roller 44A, to transport the medium P to the retransport unit 48. Thus, the retransport unit 48 feeds the medium P to the image-forming section 20, with the back side of the medium P facing the outer surface of the intermediate transfer belt 82.

To form an image on one surface (front surface) of the medium P again, after the medium P is output from the fixing device 90, the medium transport section 40 switches the transport-direction switching unit 46 to transport the medium P to the retransport unit 48. The retransport unit 48 then feeds the medium P to the image-forming section 20 again, with the front side of the medium P facing the outer surface of the intermediate transfer belt 82.

Document Reader

The document reader 50 reads image information from a document and transmits the image information to the controller 100.

Controller

The controller 100 controls the various sections of the image-forming apparatus 10 based on image information received from the document reader 50 or an external device (not shown) such as a computer.

The controller 100 converts the image information into image signals for four colors (Y, M, C, and K) and transmit the image signals to the exposure devices 66Y, 66M, 66C, and 66K. The controller 100 also generates image signals for the special color (S) and white (W) and transmit the image signals to the exposure devices 66S and 66W.

Normal Operation of Image-Forming Apparatus

Next, the normal operation of the image-forming apparatus 10 according to the first exemplary embodiment will be described with reference to FIGS. 1 and 2. In the normal operation, the image-forming apparatus 10 forms an image on a medium P using at least one of the yellow (Y), magenta (M), cyan (C), and black (K) toners without using the special color (S) and white (W) toners.

Upon receiving image information, the controller 100 operates the image-forming apparatus 10. The controller 100 converts the image information into image data for yellow (Y), magenta (M), cyan (C), and black (K). The controller 100 then outputs the image data to the exposure devices 66Y, 66M, 66C, and 66K.

The exposure devices 66 emit exposure light L based on the image data. The exposure light L is incident on the outer surfaces of the photoreceptor drums 62 charged by the charging devices 64 to form electrostatic latent images corresponding to the image data on the outer surfaces of the photoreceptor drums 62.

The electrostatic latent images formed on the outer surfaces of the photoreceptor drums 62 are developed by the developing devices 68 to form toner images.

The toner images are transferred from the outer surfaces of the photoreceptor drums 62 to the outer surfaces of the intermediate transfer belt 82 by the first transfer rollers 84 disposed opposite the outer surfaces of the photoreceptor drums 62.

A medium P is fed from any medium container 30 to the medium feed unit 42 and is transported to the transfer nip T2 in accordance with the timing when the portion of the intermediate transfer belt 82 on which the toner image is located reaches the transfer nip T2. The toner image is transferred from the outer surface of the intermediate transfer belt 82 to the medium P transported to and passing through the transfer nip T2.

The medium P to which the toner image is transferred is transported to the fixing device 90. In the fixing device 90, the fixing belt 90A and the pressing roller 90B heat and press the toner image to fix the toner image to the medium P.

The medium P to which the toner image is fixed is output from the medium output unit 44 outside the image-forming apparatus 10. Thus, the image-forming operation is completed.

To form images on both sides of the medium P, the image-forming apparatus 10 operates as follows. Specifically, as shown in FIG. 1, after the toner image formed on the front side of the medium P is fixed by the fixing device 90, the medium P is transported by the medium transport section 40 until the leading portion thereof is output outside the image-forming apparatus 10.

The transport roller 44A is then rotated in the reverse direction to draw the medium P back into the image-forming apparatus 10. At the same time, the transport-direction switching unit 46 is switched to transport the medium P to the retransport unit 48. The medium P is fed to the image-forming section 20 again, with the back side of the medium P facing the outer surface of the intermediate transfer belt 82.

Thereafter, a toner image is transferred to the back surface of the medium P in the transfer nip T2 and is fixed by the fixing device 90. Finally, the medium P to which the toner images are fixed on both sides thereof is output from the medium output unit 44 outside the image-forming apparatus 10. Thus, the image-forming operation is completed.

Operation of Image-Forming Apparatus for Use of White (W) Toner

Next, the operation of the image-forming apparatus 10 according to the first exemplary embodiment for the use of the white (W) toner will be described with reference to FIGS. 1 and 2. In this operation, the image-forming apparatus 10 forms an image on a medium P using at least one of the yellow (Y), magenta (M), cyan (C), and black (K) toners (hereinafter also referred to as "color toner") in combination with the white (W) toner (hereinafter also referred to as "white toner"). In this case, an image formed by the color toners is superimposed on a layer of the white toner on the medium P. That is, the white toner layer is used as an underlayer for the image formed by the color toners.

The medium P used in this operation is color paper such as black, blue, or red paper, i.e., paper other than white paper, rather than normal paper (PPC paper). Color paper is an example of a medium P.

Upon receiving image information, the controller 100 operates the image-forming apparatus 10. This image information contains information about the formation of an image on color paper.

The controller 100 converts the image information into image data for yellow (Y), magenta (M), cyan (C), and black (K). The controller 100 also generates layer data for white (W) based on the image data for yellow (Y), magenta (M), and cyan (C). The controller 100 outputs the image data and the layer data for white (W) to the exposure devices 66Y, 66M, 66C, 66K, and 66W. The layer data for white (W) is used to form an underlayer for an image formed by the color toners.

The exposure devices 66Y, 66M, 66C, and 66K emit exposure light L based on the image data. The exposure light L is incident on the outer surfaces of the photoreceptor drums 62Y, 62M, 62C, and 62K charged by the charging devices 64Y, 64M, 64C, and 64K to form electrostatic latent images corresponding to the image data on the outer surfaces of the photoreceptor drums 62Y, 62M, 62C, and 62K.

In synchronization with this, the exposure device 66W emits exposure light L based on the layer data for white (W). The exposure light L is incident on the outer surface of the photoreceptor drum 62W charged by the charging device 64W to form an electrostatic latent image corresponding to the layer data for white (W) on the outer surface of the photoreceptor drum 62W.

The electrostatic latent images formed on the outer surfaces of the photoreceptor drums 62Y, 62M, 62C, and 62K are developed by the developing devices 68Y, 68M, 68C, and 68K to form yellow (Y), magenta (M), cyan (C), and black (K) toner images, respectively. The electrostatic latent image formed on the outer surface of the photoreceptor drum 62W is developed by the developing device 68W to form a white toner layer.

The yellow (Y), magenta (M), cyan (C), and black (K) toner images are transferred from the outer surfaces of the photoreceptor drums 62Y, 62M, 62C, and 62K to the outer surface of the intermediate transfer belt 82 by the first transfer rollers 84 disposed opposite the outer surfaces of the photoreceptor drums 62Y, 62M, 62C, and 62K. The white toner layer is transferred from the outer surface of the photoreceptor drum 62W to the outer surface of the intermediate transfer belt 82 by the first transfer roller 84 disposed opposite the outer surface of the photoreceptor drum 62W.

In this case, the white toner layer is transferred to the outer surface of the intermediate transfer belt 82 such that the white toner layer is superimposed on the color toner images previously transferred thereto.

Color paper is fed from any medium container 30 to the medium feed unit 42 and is transported to the transfer nip T2 in accordance with the timing when the color toner image and the white toner layer superimposed on the color toner image on the outer surface of the intermediate transfer belt 82 reach the transfer nip T2. The toner image and the white toner layer are transferred from the outer surface of the intermediate transfer belt 82 to the color paper transported to and passing through the transfer nip T2.

After passing through the transfer nip T2, the color paper is transported to the fixing device 90. In the fixing device 90, the fixing belt 90A and the pressing roller 90B heat and press the toner image and the white toner layer to fix the toner image and the white toner layer to the color paper. In this exemplary embodiment, the temperature of the outer surface of the fixing belt 90A is 160° C. In this case, the temperature at which the toner image and the white toner layer are fixed to the color paper (hereinafter referred to as "fixing temperature") is 160° C.

The color paper is then output from the medium output unit 44 outside the image-forming apparatus 10. Thus, the image-forming operation is completed.

To form images on both sides of the color paper, after the toner image is fixed to the front side of the color paper, the color paper is drawn back into the image-forming apparatus 10 and is transported by the retransport unit 48, as in the normal operation of the image-forming apparatus 10. The color paper is then fed to the image-forming section 20, with the back side of the color paper facing the outer surface of the intermediate transfer belt 82, and a color toner image superimposed on a white toner layer is formed in the same manner as the toner image on the front side.

TMA of White Toner on Color Paper

In the image-forming apparatus 10 according to the first exemplary embodiment, the toner mass per unit area of a white toner θ (g/m$^2$) transferred to color paper satisfies expression 1 below. Expression 1 below is defined by the average particle diameter Rw (μm) of a white toner, the average particle diameter Rc (μm) of a color toner, the storage modulus Gw (kPa) of the white toner, and the storage modulus Gc (kPa) of the color toner. The toner mass per unit area θ ($g/m^2$) is hereinafter abbreviated as "TMA".

Expression 1

Expression 1 is as follows:

$$0.03+1.31\times Rw-0.47\times Rc+0.02\times Gw-0.07\times Gc\leq\theta\leq 0.05+1.06\times Rw+0.42\times Rc-0.02\times Gw+0.05\times Gc$$

In the first exemplary embodiment, the average particle diameters of the white toner and the color toner are by volume.

The volume average particle diameters of the white toner and the color toner are measured, for example, using a Multisizer II (available from Beckman Coulter, Inc.) and, as an electrolyte, ISOTON-II (available from Beckman Coulter, Inc.). In this measurement, 0.5 to 50 mg of a measurement sample is added to 2 mL of a 5% aqueous solution of a surfactant, such as sodium alkylbenzenesulfonate, as a dispersant, and it is added to 100 to 150 mL of the electrolyte.

The sample suspended in the electrolyte is dispersed by an ultrasonic disperser for 1 minute. The particle diameter distribution of particles with particle diameters of 2.0 to 60 μm is then measured by a Multisizer II with an aperture diameter of 100 nm, where 50,000 particles are sampled.

In the first exemplary embodiment, the storage modulus of the white toner at the fixing temperature is higher than or equal to that of the color toner at the fixing temperature. If the storage modulus of the white toner is lower than that of the color toner, part of the white toner is absorbed into the color paper at the fixing temperature at which the color reproducibility after the fixing of the color toner is within the acceptable range. This decreases the hiding power of the white toner on the color paper.

The storage modulus G' of a toner is the real part of the shear complex modulus G* at a measurement temperature of T° C. Specifically, the storage modulus G' is measured by a viscoelastometer according to the method specified in JIS K7244-6, entitled "Plastics—Determination of Dynamic Mechanical Properties—Part 6: Shear Vibration—Non-Resonance Method".

As shown in expression 1, the upper and lower limits of the TMA are specified using Rw, Rc, Gw, and Gc as parameters. The upper and lower limits of the TMA will now be described based on experimental results. The lower limit of the TMA will be described first, and then the upper limit of the TMA will be described.

Experiments for Determining Lower Limit of TMA of White Toner on Color Paper

FIGS. 4 to 7 (Experiments 1 to 4) show the results of experiments for determining the lower limit of the TMA of a white toner on color paper using the average particle diameters of the white toner and a color toner as parameters. As shown in FIG. 3, the individual experiments use combinations of a white toner and a color toner with different storage moduli.

Experiments for Determining Upper Limit of TMA of White Toner on Color Paper

FIGS. 8 to 11 (Experiments 5 to 8) show the results of experiments for determining the upper limit of the TMA of a white toner on color paper using the average particle diameters of the white toner and a color toner as parameters. As shown in FIG. 3, the individual experiments use combinations of a white toner and a color toner with different storage moduli.

Experiment Procedure

The upper and lower limits of the TMA in FIGS. 4 to 11 (Experiments 1 to 8) are determined as follows. Using the image-forming apparatus 10, a color toner image and a white toner layer superimposed on the color toner image are transferred and fixed to color paper. Thereafter, the toner image formed on the color paper is evaluated for color reproducibility. The toner image is formed from yellow (Y), magenta (M), and cyan (C) toners. In this case, toner images formed on color paper with varying TMAs of the white toner layer are evaluated.

Toner images formed on color paper are evaluated for color reproducibility as follows. An image is first formed on normal paper by the normal operation of the image-forming apparatus 10 described above to prepare an image sample used as a reference for color reproducibility. The photometric characteristics of a predetermined portion of the reference image sample are then measured by a photometer. Next, toner images are formed on color paper based on the same image data used in the above normal operation to prepare image samples with varying TMAs of the white toner layer. The photometric characteristics of a predetermined portion of each image sample are then measured by a photometer. The measurements of the image samples are compared with those of the reference image sample to determine whether they fall within predetermined reference limits (sensory evaluation).

FIGS. 4 to 7 (Experiments 1 to 4) show the limit of the acceptable range of color reproducibility on color paper as the TMA is decreased based on the above sensory evaluation. That is, FIGS. 4 to 7 show the lower limits of the TMA in the experiments (Experiments 1 to 4). FIGS. 8 to 11 (Experiments 5 to 8) show the limit of the acceptable range of color reproducibility on color paper as the TMA is increased based on the above sensory evaluation. That is, FIGS. 8 to 11 show the upper limits of the TMA in the experiments (Experiments 5 to 8).

Expression 1 is derived from a regression analysis of the lower limits of the TMA in FIGS. 4 to 7 (Experiments 1 to 4) and the upper limits of the TMA in FIGS. 8 to 11 (Experiments 5 to 8).

Method for Measuring TMA

As described above, an image formed by the color toners is superimposed on a layer of the white toner on a medium P. To measure the TMA of the white toner, only the white toner is transferred to the outer surface of the intermediate transfer belt 82 while preventing the color toners from being deposited on the outer surfaces of the photoreceptor drums 62Y, 62M, 62C, and 62K. The white toner is then transferred to color paper, and the image-forming apparatus 10 is stopped before the color paper passes through the fixing device 90. The color paper to which only the white toner is transferred but not fixed is removed from the image-forming apparatus 10. The TMA is determined by measuring the mass of the white toner transferred to the color paper and dividing it by the area in which the white toner is deposited.

To prevent the color toners from being deposited on the outer surfaces of the photoreceptor drums 62Y, 62M, 62C, and 62K, the controller 100 may shut off the exposure light L from the exposure devices 66Y, 66M, 66C, and 66K so that no electrostatic latent image is formed on the outer surfaces of the photoreceptor drums 62Y, 62M, 62C, and 62K. To measure the mass of the white toner transferred to the color paper, the white toner is collected by a suction device (not shown) equipped with a filter (filter that captures the white toner while allowing air to pass). The mass of the collected white toner is determined from the difference between the masses of the filter before and after suction and is divided by the area of the portion of the color paper from which the white toner is collected.

Advantages of First Exemplary Embodiment

Figure 20:
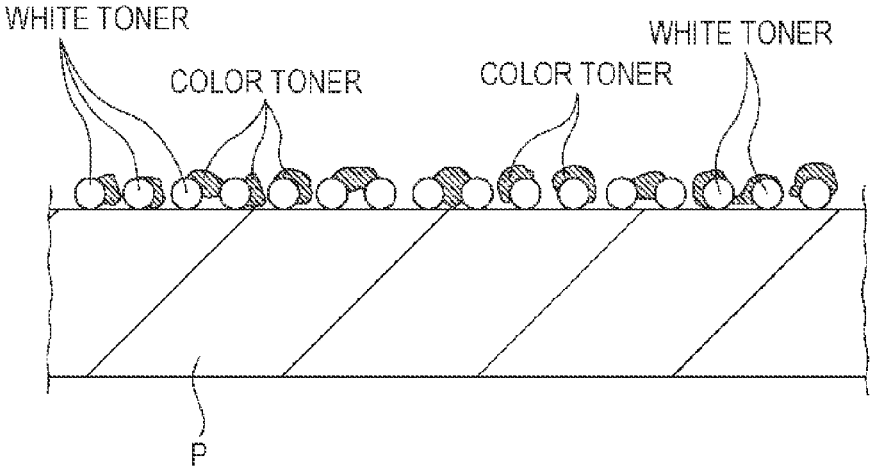
FIG. 20 is a conceptual diagram (sectional view) illustrating the condition of a white toner layer and a color toner layer fixed to a medium in a comparative example where the TMA of the white toner layer is smaller than the lower limit.
Figure 23:
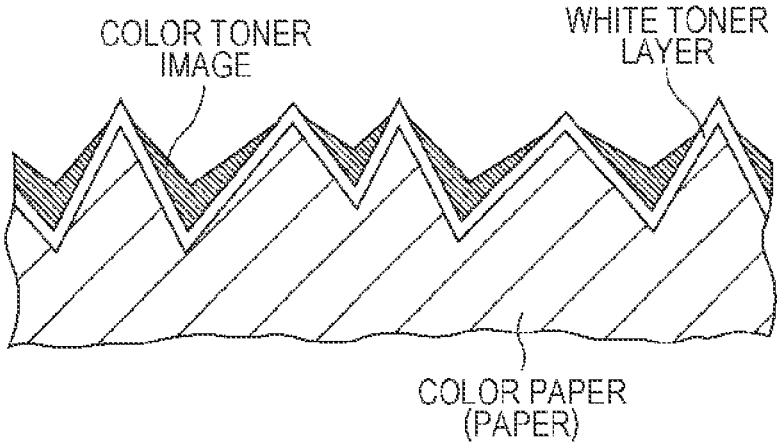
FIG. 23 is a conceptual diagram (sectional view) illustrating the condition of a white toner layer and a color toner layer fixed to color paper in a comparative example where the TMA of the white toner layer is smaller than the lower limit.

As shown in the conceptual diagram in FIG. 20, if the TMA of the white toner is smaller than the lower limit of expression 1, the color toner superimposed on the white toner layer on the color paper melts and enters gaps in the white toner before the white toner melts, and the color toner is fixed in this state. In this case, the white toner underlayer is incompletely formed below the toner image. In addition, because the color paper (paper) has surface irregularities of sizes equal to or larger than the particle diameter of the toner, the white toner may be exposed in the surface of the color paper after the toner image is fixed thereto (see FIG. 23). In this case, part of the white toner, which is intended to function as an underlayer for the color toner, appears as white spots in the image.

In contrast, if expression 1 is satisfied, the color reproducibility of the toner image may be improved compared to the case where expression 1 is not satisfied because the white toner underlayer may be substantially completely formed below the toner image. In addition, if expression 1 is satisfied, few white spots may appear in the image.

Figure 21:
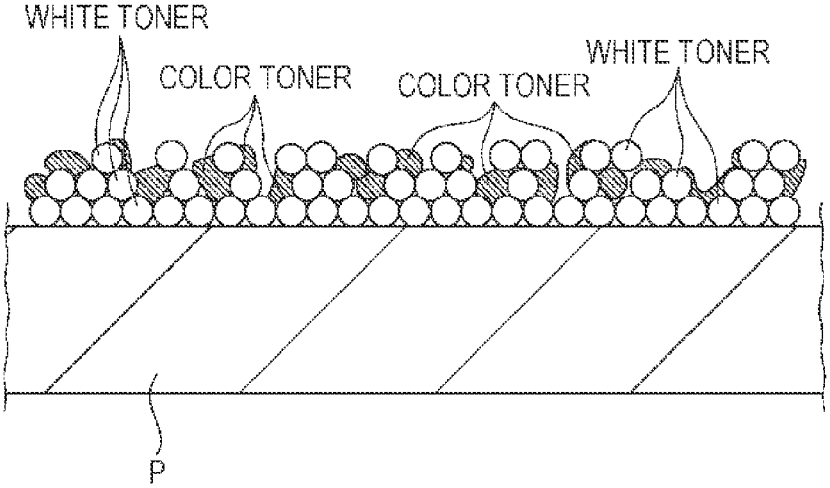
FIG. 21 is a conceptual diagram (sectional view) illustrating the condition of a white toner layer and a color toner layer fixed to a medium in a comparative example where the TMA of the white toner layer is larger than the upper limit.

As shown in FIG. 21, if the TMA of the white toner is larger than the upper limit of expression 1, the white toner may provide a higher hiding power for the toner image on the color paper. The white toner, however, mixes with the color toner and thus makes the color thereof thinner.

In contrast, if expression 1 is satisfied, the color of the color toner may be maintained because little white toner may mix with the color toner.

Figure 22:
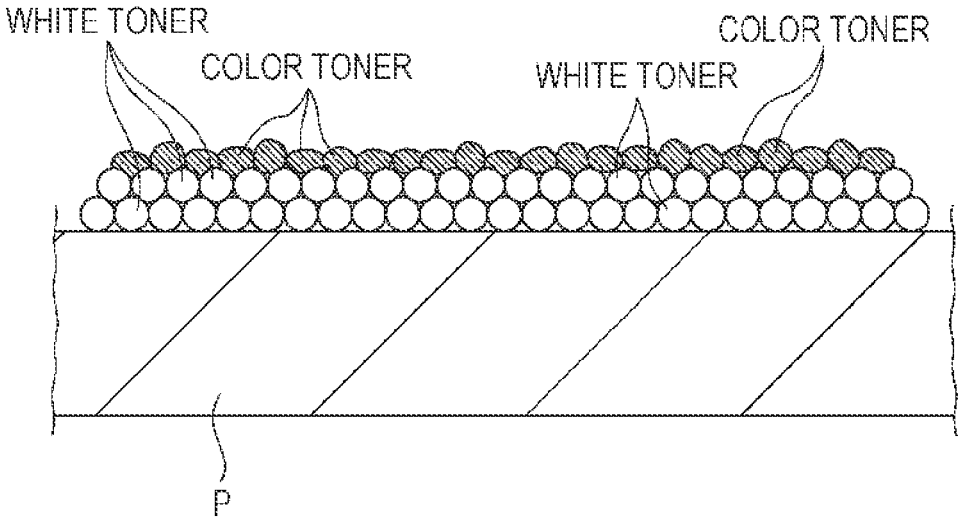
FIG. 22 is a conceptual diagram (sectional view) illustrating the condition of a white toner layer and a color toner layer fixed to a medium in an image formed by the image-forming apparatus according to the first or second exemplary embodiment.

Thus, with the image-forming apparatus 10, the color reproducibility of a color toner image superimposed on a white toner layer fixed to color paper may be improved compared to the case where the TMA of the white toner does not satisfy expression 1 (see FIG. 22).

In the image-forming apparatus 10, the intensity of the exposure light emitted from the exposure device 66W is set so that the TMA of the white toner satisfies expression 1. The intensity of the exposure light emitted from the exposure device 66W is adjusted based on temperature and humidity information transmitted from a temperature and humidity sensor (not shown) disposed in the image-forming apparatus 10 to the controller 100.

Second Exemplary Embodiment

Next, a second exemplary embodiment will be described with reference to FIGS. 12 to 22, focusing on the differences from the first exemplary embodiment. The second exemplary embodiment differs in that the medium P is a film, rather than color paper. The film (medium P) used in the second exemplary embodiment is a transparent film. Films are an example of a medium P.

TMA of White Toner on Film

In the second exemplary embodiment, the TMA of a white toner transferred to a film satisfies expression 2 below. Expression 2 below is defined by the average particle diameter Rw (μm) of a white toner, the average particle diameter Rc (μm) of a color toner, the storage modulus Gw (kPa) of the white toner at 120° C., and the storage modulus Gc (kPa) of the color toner at 120° C. In expression 2 below, the TMA is denoted by θ.

$$0.04+1.09\times Rw-0.40\times Rc+0.01\times Gw-0.05\times Gc\leq\theta\leq 0.05+0.96\times Rw+0.38\times Rc-0.02\times Gw+0.04\times Gc \quad \text{Expression 2}$$

Experiments for Determining Lower Limit of TMA of White Toner on Film

FIGS. 12 to 15 (Experiments 9 to 12) show the results of experiments for determining the lower limit of the TMA of a white toner on a film using the average particle diameters of the white toner and a color toner as parameters. As shown in FIG. 3, the individual experiments use combinations of a white toner and a color toner with different storage moduli.

Experiments for Determining Upper Limit of TMA of White Toner on Film

FIGS. 16 to 19 (Experiments 13 to 16) show the results of experiments for determining the upper limit of the TMA of a white toner on a film using the average particle diameters of the white toner and a color toner as parameters. As shown in FIG. 3, the individual experiments use combinations of a white toner and a color toner with different storage moduli.

Advantages of Second Exemplary Embodiment

As shown in FIG. 20, if the TMA of the white toner is smaller than the lower limit of expression 2, the color toner superimposed on the white toner layer on the film melts and enters gaps in the white toner before the white toner melts, and the color toner is fixed in this state. In this case, the white toner layer is less effective in hiding the film because it does not completely cover the region between the film and the color toner image.

In contrast, if expression 2 is satisfied, the white toner may hide the film, thus improving the color reproducibility of the color toner image superimposed on the white toner layer.

As shown in FIG. 21, if the TMA of the white toner is larger than the upper limit of expression 2, the white toner may provide a higher hiding power for the toner image on the film. The white toner, however, mixes with the color toner and thus makes the color thereof thinner.

In contrast, if expression 2 is satisfied, the color of the color toner may be maintained because little white toner may mix with the color toner.

Thus, according to the second exemplary embodiment, the color reproducibility of a color toner image superimposed on a white toner layer fixed to a film may be improved compared to the case where the TMA of the white toner does not satisfy expression 2 (see FIG. 22).

Modification

Next, a modification of the second exemplary embodiment will be described, focusing on the differences from the first and second exemplary embodiments. This modification combines the functions of the first and second exemplary embodiments described above. Specifically, this modification has a mode in which an image is formed on normal paper by the normal operation, a mode in which an image is formed on color paper using a white toner as an underlayer, and a mode in which an image is formed on a film using a white toner as an underlayer. Any of the above modes is selected based on information about the medium received by the controller 100 to perform an image-forming operation.

Whereas color paper (paper) has surface irregularities of sizes equal to or larger than the particle diameter of the toner, a film has no such surface irregularities. Accordingly, the optimum TMA is smaller on a film than on color paper (see FIGS. 4 to 19).

Advantages of Modification

According to this modification, the color reproducibility of a color toner image superimposed on a white toner layer fixed to a selected medium P may be improved compared to the case where the functions of the first and second exemplary embodiments described above are not combined.

Although particular exemplary embodiments of the present invention have been described above in detail, the present invention is not limited to such exemplary embodiments; various other exemplary embodiments are possible within the scope of the present invention.

For example, the white toner may have any color that allows a color toner image superimposed on the white toner to have color reproducibility within the acceptable range if expression 1 or 2 is satisfied.

If the white toner is frequently used in image-forming operations, the toner-image forming unit 60S may be configured for use with the same white toner as the toner-image forming unit 60W. Alternatively, the toner-image forming units 60S and 60W may be configured for use with white toners having different color-forming properties.

Films are not limited to transparent films made of resins such as polyethylene terephthalate (PET) and polyvinyl chloride, but include color films containing dyes.

Although the white toner has been described as an underlayer for the color toner, the image-forming apparatus 10 may have a mode in which images such as characters and patterns are formed using the white toner.

Although the black (K) toner has been described as being deposited on a white toner layer (underlayer), the black (K) toner may be directly deposited on color paper or film without forming a white toner underlayer.

Although expression 1 (or expression 2) has been described as being satisfied by setting the intensity of the exposure light emitted from the exposure device 66W, it may be satisfied by setting, for example, the voltage applied to the toner supply members 68A of the developing device 68W, the distance between the limiting member and the toner supply members 68A, or the peripheral velocity of the toner supply members 68A. Alternatively, expression 1 (or expression 2) may be satisfied by setting, for example, the charge potential of the charging device 64W or the first transfer bias applied to the first transfer roller 84 opposite the photoreceptor drum 62W.

Although color toner images and a white toner layer have been described as being simultaneously transferred to a medium P by second transfer, monochrome toner images and layer may be formed on the respective image carriers and may then be sequentially transferred to a medium P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

an image unit that forms an image using a white toner and a color toner; and a fixing unit that fixes the image to a medium with heat, wherein the toner mass per unit area of the white toner θ ($g/m^2$) in an image of the color toner superimposed on the white toner formed on paper used as the medium satisfies:

$$0.03+1.31\times Rw-0.47\times Rc+0.02\times Gw-0.07\times Gc\leq\theta\leq 0.05+1.06\times Rw+0.42\times Rc-0.02\times Gw+0.05\times Gc$$

where

Rw is the average particle diameter (μm) of the white toner,

Rc is the average particle diameter (μm) of the color toner,

Gw is the storage modulus (kPa) of the white toner at 120° C., and

Gc is the storage modulus (kPa) of the color toner at 120° C.

2. The image-forming apparatus according to claim 1, wherein the toner mass per unit area of the white toner θ ($g/m^2$) in an image of the color toner superimposed on the white toner formed on a film used as the medium satisfies:

$$0.04+1.09\times Rw-0.40\times Rc+0.01\times Gw-0.05\times Gc\leq\theta\leq 0.05+0.96\times Rw+0.38\times Rc-0.02\times Gw+0.04\times Gc.$$

3. An image-forming apparatus comprising:

an image unit that forms an image using a white toner and a color toner; and a fixing unit that fixes the image to a medium with heat, wherein the toner mass per unit area of the white toner θ ($g/m^2$) in an image of the color toner superimposed on the white toner formed on a film used as the medium satisfies:

$$0.04+1.09\times Rw-0.40\times Rc+0.01\times Gw-0.05\times Gc\leq\theta\leq 0.05+0.96\times Rw+0.38\times Rc-0.02\times Gw+0.04\times Gc$$

where

Rw is the average particle diameter (μm) of the white toner,

Rc is the average particle diameter (μm) of the color toner,

Gw is the storage modulus (kPa) of the white toner at 120° C., and

Gc is the storage modulus (kPa) of the color toner at 120° C.

4. An image-forming method comprising:

forming an image using a white toner and a color toner; and fixing the image to a medium with heat, wherein the toner mass per unit area of the white toner θ ($g/m^2$) in an image of the color toner superimposed on the white toner formed on paper used as the medium satisfies:

$$0.03+1.31\times Rw-0.47\times Rc+0.02\times Gw-0.07\times Gc\leq\theta\leq 0.05+1.06\times Rw+0.42\times Rc-0.02\times Gw+0.05\times Gc$$

where

Rw is the average particle diameter (μm) of the white toner,

Rc is the average particle diameter (μm) of the color toner,

Gw is the storage modulus (kPa) of the white toner at 120° C., and

Gc is the storage modulus (kPa) of the color toner at 120° C.

* * * * *